United States Patent [19]

Araya et al.

[11] Patent Number: 4,483,390

[45] Date of Patent: Nov. 20, 1984

[54] HEATER CORE OF AN AUTOMOTIVE AIR CONDITIONING DEVICE

[75] Inventors: Katsutoshi Araya, Sagamihara; Hiroshi Tanaami, Sano, both of Japan

[73] Assignees: Nissan Motor Company, Limited, Yokohama; Nihon Radiator Co. Ltd., Tokyo, both of Japan

[21] Appl. No.: 403,860

[22] Filed: Jul. 30, 1982

[30] Foreign Application Priority Data

Sep. 30, 1981 [JP] Japan ..... 56-155656

[51] Int. Cl.[3] ..... F28F 13/00

[52] U.S. Cl. ..... 165/104.32; 165/DIG. 24

[58] Field of Search ..... 165/104.32, 110, DIG. 24

[56] References Cited

U.S. PATENT DOCUMENTS

| | | | |
|---|---|---|---|
| 1,389,997 | 9/1921 | Sedgwick . | |
| 1,734,923 | 11/1929 | Swank . | |
| 2,924,438 | 2/1960 | Malkoff | 165/110 |
| 3,077,927 | 2/1963 | White et al. | 165/72 |
| 3,455,541 | 7/1969 | Cavitt | 165/110 X |
| 3,533,465 | 10/1970 | Bennett et al. | 165/107 |
| 4,006,775 | 2/1977 | Avrea | 165/51 |
| 4,194,493 | 3/1980 | De Grijs | 165/104.32 X |
| 4,366,858 | 1/1983 | Moranne | 165/104.32 |

FOREIGN PATENT DOCUMENTS

| | | |
|---|---|---|
| 1286713 | 1/1962 | France . |
| 1370860 | 10/1974 | United Kingdom . |
| 1471734 | 4/1977 | United Kingdom . |

*Primary Examiner*—Albert W. Davis, Jr.

*Attorney, Agent, or Firm*—Schwartz, Jeffery, Schwaab, Mack, Blumenthal & Koch

[57] ABSTRACT

In a heater core comprising space first and second water tanks, parallel tubes interposed between the tanks to provide a fluid communication therebetween, heat radiation fins each being disposed between the mutually neighboring two tubes and a water outlet tube connected to the first water tank for discharging water from the heater core, there is provided an air escaping tube which has one end located at a predetermined portion of the first water tank and the other end located in the water outlet tube. The predetermined portion of the first water tank is a portion where a so-called air pocket tends to appear under practical operation of the heater core.

10 Claims, 6 Drawing Figures

HEATER CORE OF AN AUTOMOTIVE AIR CONDITIONING DEVICE

BACKGROUND OF THE INVENTION

The present invention relates in general to an air conditioning device of an automobile, and more particularly to a heater core which is mounted in the air conditioning device.

SUMMARY OF THE INVENTION

It is an object of the present invention to provide an improved heater core which is free of a so-called "air pocket".

According to the present invention, there is provided a heater core which comprises first and second water tanks which are spaced from each other; a plurality of parallel tubes interposed or spanned between the two water tanks to provide a fluid communication therebetween; a plurality of heat radiation fins each being disposed between the mutually neighbouring two tubes; a water outlet tube connected to the first water tank for discharging water from the heater core; and an air escaping tube extending from a predetermined interior portion of the first water tank to the interior of the water outlet tube, the predetermined interior portion being a portion where an air pocket tends to appear under practical operation of the heater core.

BRIEF DESCRIPTION OF THE DRAWINGS

Other objects and advantages of the present invention will become clear from the following description when taken in conjunction with the accompanying drawings, in which.

DESCRIPTION OF THE PRIOR ART

Figure 1:
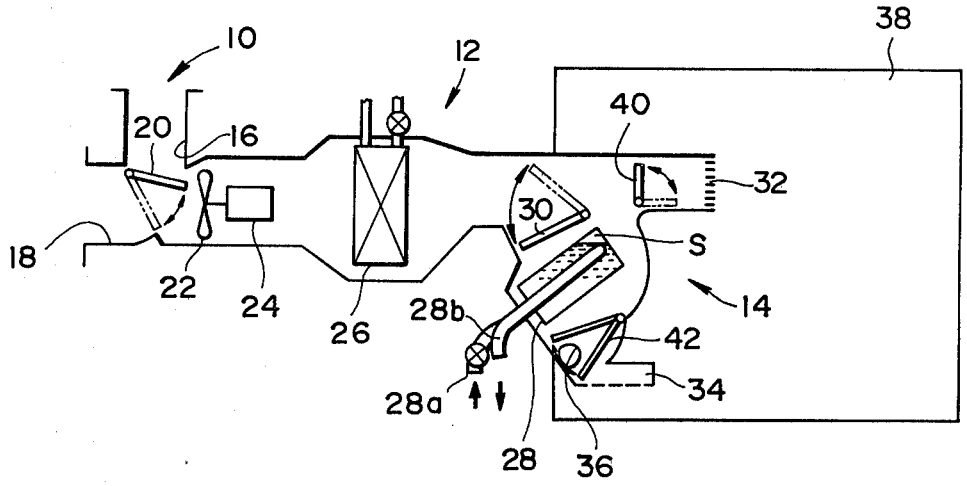
FIG. 1 is a schematic illustration of an air conditioning device of a motor vehicle.

Prior to describing the heater core of the present invention, an air conditioning system of a motor vehicle will be outlined with reference to FIG. 1 in order to clarify the invention.

Referring to FIG. 1, there is shown, in schematic manner, an air conditioning system of a motor vehicle, which generally comprises an air intake unit 10, a cooler unit 12 and a heater unit 14. The air intake unit 10 comprises an outside air intake duct 16, an inside air intake duct 18, an intake door 20, and a blower 22 driven by an electric motor 24. By changing the angular position of the intake door 20, the air intake ratio between the outside and inside air intake ducts 16 and 18 changes. The cooler unit 12 comprises an evaporator 26 for cooling the air flowing thereto from the air intake unit 10. The heater unit 14 comprises a heater core 28 for heating, by using the engine cooling water, air flowing therethrough from the cooler unit 12. The heater core comprises generally two spaced water tanks, parallel tubes connecting these two tanks, and heat radiation fins disposed between the adjacent tubes. A water inlet tube **28*a* is connected to a lower portion of the heater core 28 for feeding the engine cooling water to the core 28, while a water outlet tube 28*b* is connected to an upper portion of the core 28 for discharging the water therefrom. At the upstream section of the heater core 28, an air mix door 30 is mounted for controlling the air flow directed toward the heater core 28. The heater unit 14 further comprises a center ventilator duct 32, a floor duct 34 and a defroster duct 36 from which ducts conditioned air flows into the vehicle cabin 38. Although not shown, the inside air intake duct 18 of the air intake unit 10 is connected to the vehicle cabin 38**.

However, in a conventional heater unit of the type as mentioned hereinabove, the heater core 28 is assembled to be inclined by a certain degree due to the dimensional limitation of the heater unit. Thus, in practical use, there is inevitably formed, at the upper section of the interior of the heater core 28, an air pocket S which may be filled with bubbles. As is known, the presence of such bubbles lowers the heat exchanging efficiency of the heater core 28.

DETAILED DESCRIPTION OF THE INVENTION

Therefore, to solve the above-mentioned drawbacks is an essential object of the invention. As will become clear as the description proceeds, the present invention proposes a measure for removing such air pocket from the interior of the heater core.

Figure 2:
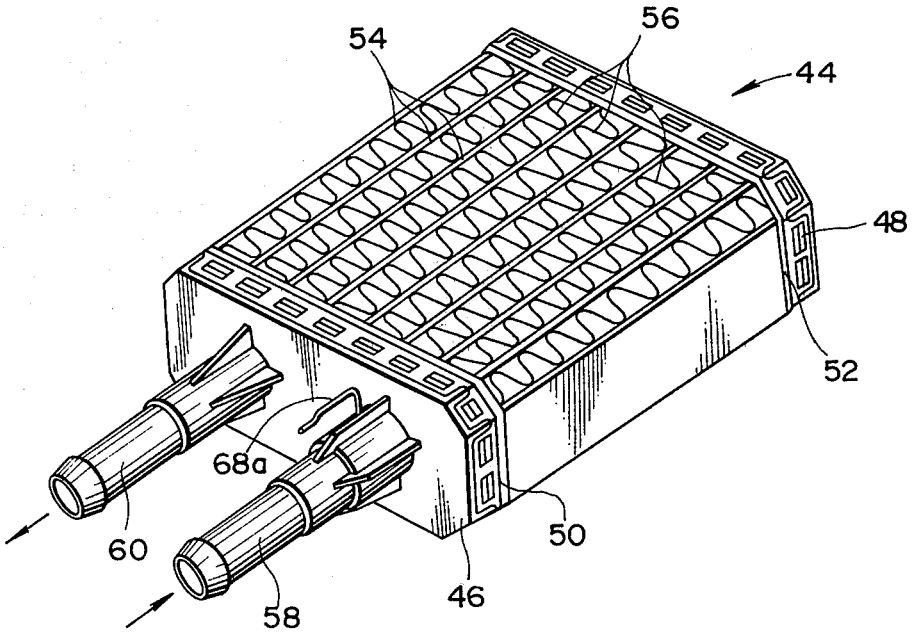
FIG. 2 is a perspective view of a heater core according to the present invention.
Figure 3:
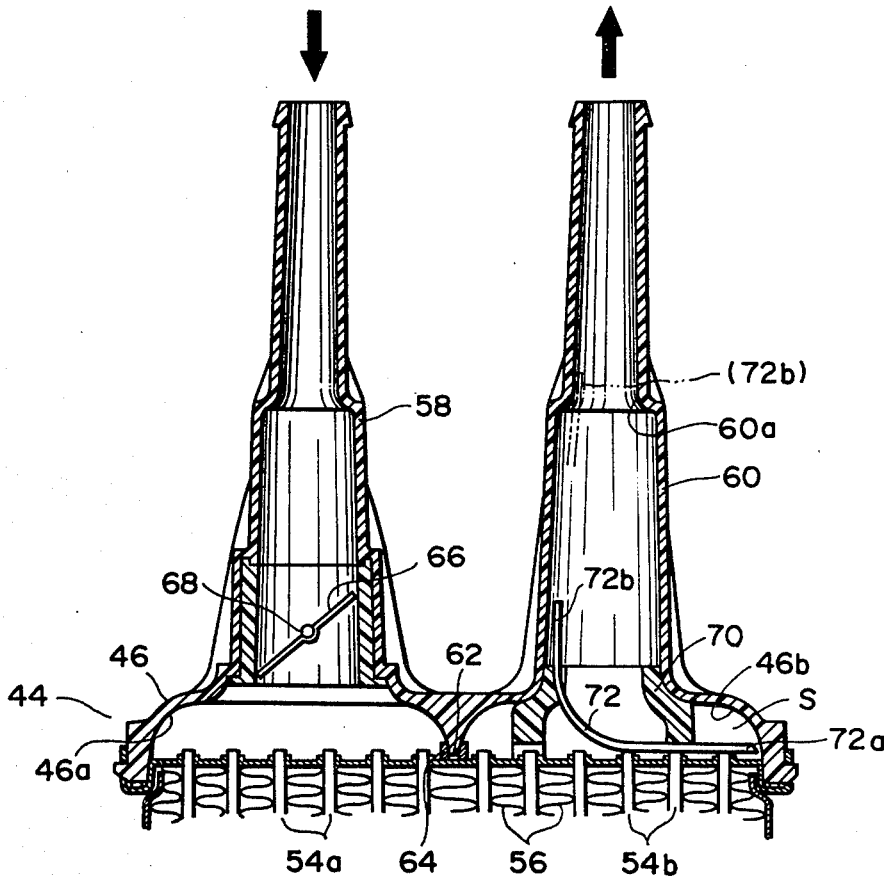
FIG. 3 is a longitudinally sectioned partial view of the heater core of FIG. 2.

Referring to FIGS. 2 to 6, especially FIGS. 2 and 3, there is shown a rectangular heater core 44 according to the present invention. As is seen from FIG. 2, the heater core 44 comprises two spaced rectangular water tanks 46 and 48 which are seated on respective seat plates 50 and 52. A plurality of parallel tubes 54 connect the two tanks 46 and 48, and a plurality of heat radiation fins 56 are securely disposed between the mutually neighbouring tubes 54 as shown. A water inlet tube 58 and a water outlet tube 60 are connected to the tank 46 for feeding and discharging the engine cooling water into and from the heater core, respectively.

As is seen from FIG. 3, the interior of the tank 46 is divided into upstream and downstream sections **46*a* and 46*b* by a partition wall 62. A sealing packing 64 is mounted on the top of the partition wall 62 to assure the seal between these two sections 46*a* and 46*b*. With this construction, under operation of the heater core 44, the water from the engine cooling water circuit (not shown) flows through the water inlet tube 58 into the upstream section 46*a*, and flows through the tubes 54*a* into the other tank 48, and flows through the other tubes 54*b* into the downstream section 46*b*, and returns through the water outlet tube 60 to the engine cooling water circuit. During this flow, heat exchange is effected, at the tubes 54*a* and 54*b*, between the circulating water and air which flows through the fins 56**, so that the air to be discharged into the vehicle cabin is warmed.

Within the water inlet tube 58, there is provided a flow control valve which comprises a valve plate 66 mounted on a rotatable shaft 68. The shaft 68 has a handle section **68*a* projecting to the outside as is seen in FIG. 2. Thus, the water flow rate in the heater core 44** changes in accordance with the angular position of the control valve.

Within the downstream section 46*b* of the tank 46, there is tightly disposed a cylindrical holder 70 of plastics which is used for supporting an air escaping tube 72. As is seen from FIG. 3, an end 72*a* of the tube 72 is located at an outside corner S of the downstream section 46*b*, while, the other end 72*b* of the same is located in the water outlet tube 60. The air escaping tube is constructed of plastics or rubber materials. If desired, the holder 70 and the air escaping tube 72 may be constructed of metal. For the reason which will become clear as the description proceeds, the other end 72*b* of the tube 72 may be located at a throat portion 60*a* formed in the water outlet tube 60, as is indicated by a phantom line. Now, it is to be noted that the end 72*a* of the tube 72 is located at a portion where an air pocket tends to be formed under operation of the heater core 44.

Figure 4:
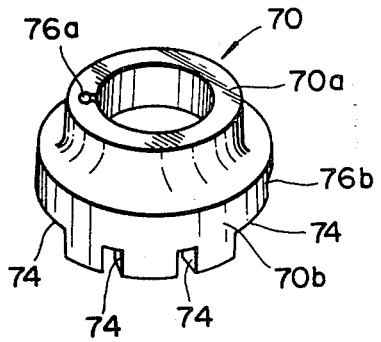
FIG. 4 is a perspective view of an air escaping tube holder mounted in the heater core of the present invention.
Figure 5:
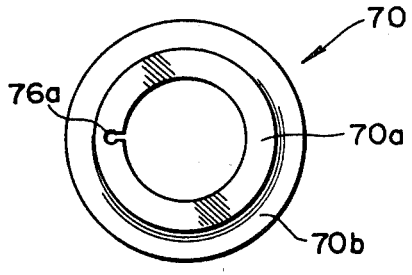
FIG. 5 is a plan view of the holder of FIG. 4.
Figure 6:
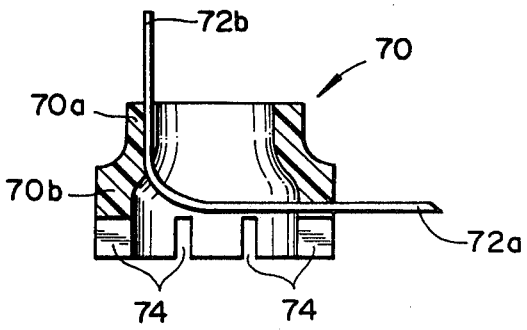
FIG. 6 is an axially sectional view of the holder with an air escaping tube mounted therein.

The detailed construction of the holder 70 is shown in FIGS. 4 to 6. The holder 70 comprises a smaller diameter portion 70*a* tightly put in the entrance section of the water outlet tube 60 (see FIG. 3), and a larger diameter portion 70*b* supported on the bottom of the downstream section 46*b* (see FIG. 3). The larger diameter section 70*b* is formed at its base portion with grooves 74 which loosely cover the open and projecting ends of the tubes 54*b*, as is seen from FIG. 3, so that the interior of the holder 70 is freely communicated with the exterior of the same through the grooves 74. Due to the positional relationship between the holder 70 and the tubes 54*b*, some of the grooves 74 are formed wider than others, as is seen from FIG. 4.

For tightly holding the air escaping tube 72, the holder 70 is formed at the smaller and larger diameter sections 70*a* and 70*b* with tube retaining grooves 76*a* and 76*b* which extend along the inside surface of the holder 70 to be merged with the interior of the same, as is understood from FIG. 6. As is seen from FIG. 5, each groove 76*a* or 76*b* has a cross section which comprises a circular portion and a throat portion, so that fixing the air escaping tube 72 to the holder 70 can be effected by only manually pressing the tube 72 into the grooves 76*a* and 76*b*.

With the air escaping tube 72 arranged in the above-stated manner, the following advantageous phenomenon is achieved under operation of the heater core 44.

Under operation of the heater core 44, the hot water from the engine travels in the heater core 44 in a manner as is described hereinabove. Thus, in the water outlet tube 60, there constantly occurs a downstream flow of water. This water flow induces a phenomenon in which the pressure at the other end 72*b* of the air escaping tube 72 is lower than that at the opposite end 72*a*. Thus, if an air pocket is formed at the corner S, the air in the pocket is sucked by the air escaping tube 72 and discharged into the water flow running downstreamly in the water outlet tube 60. The air thus carried by the water is discharged to a radiator of the engine cooling system. Thus, the undesirable air pocket disappears, that is, the air pocket becomes filled with water. Accordingly, the undesirable lowering in the heat exchanging efficiency of the heater core does not occur. When the end 72*b* of the air escaping tube 72 is located at the position indicated by the phantom line (72*b*), the air escaping effect is much more improved.

What is claimed is:

1. A heater core comprising:

first and second water tanks which are spaced from each other;

a plurality of parallel tubes extending between said first and second water tanks to provide fluid communication therebetween;

a plurality of heat radiation fins, each being disposed between mutually neighbouring tubes;

a water outlet tube connected to said first water tank for discharging water from said heater core, said water outlet tube having a throat portion formed therein;

an air escaping tube extending from a predetermined interior portion of said first water tank to the interior of said water outlet tube, said predetermined interior portion being a corner portion of said first water tank where an air pocket tends to appear under practical operation of the heater core, a downstream end of said air escaping tube being located at said throat portion; and a holder tightly held in said first water tank to tightly support thereon said air escaping tube, said holder comprising a tubular member having a smaller diameter portion tightly put in an entrance section of said water outlet tube, and a larger diameter portion supported on a bottom of said first water tank.

2. A heater core as claimed in claim 1, in which said holder is formed at its larger diameter portion with grooves for providing a fluid communication between the interior of the holder and the exterior of the same.

3. A heater core as claimed in claim 2, in which said holder is formed with a tube retaining groove into which said air escaping tube is snugly received.

4. A heater core as claimed in claim 3, in which said retaining groove extends along the inside surface of said holder to be merged with the interior of said holder.

5. A heater core as claimed in claim 4, in which said tube retaining groove has a cross section which comprises a circular portion and a throat portion, so that fixing the air escaping tube to the holder is effected by only pressing the air escaping tube into said tube retaining groove.

6. A heater core as claimed in claim 1, further comprising:

a water inlet tube connected to said first water tank for charging the tank with water; and a partition wall member sealingly disposed in said first water tank to divide the same into an upstream section merged with the interior of said water inlet tube and a downstream section merged with the interior of said water outlet tube.

7. A heater cover as claimed in claim 10, further comprising a flow control valve which is disposed in said water inlet tube to control the flow rate of water flowing into the heater core.

8. A heater core comprising:

first and second water tanks which are spaced from each other;

a plurality of parallel tubes extending between said first and second water tanks to provide fluid communication therebetween;

a plurality of heat radiation fins, each being disposed between mutually neighbouring tubes;

a water outlet tube connected to said first water tank for discharging water from said heater core, said water outlet tube having a throat portion formed therein;

an air escaping tube extending from a predetermined interior portion of said first water tank to the interior of said water outlet tube, said predetermined interior portion being a corner portion of said first tank where an air pocket tends to appear under practical operation of the heater core, a downstream end of said air escaping tube being located at said throat portion; and a holder tightly held in said first water tank and having opposed ends thereof respectively attached to the entrance portion of said water outlet tube and the bottom of said first water tank, said holder supporting thereon a portion of said air escaping tube.

9. A heater core as claimed in claim 8, in which said holder is a tubular member having one end placed tightly in an entrance section of said water outlet tube.

10. A heater core as claimed in claim 9, in which said holder comprises a smaller diameter portion tightly placed in the entrance section of said water outlet tube and a larger diameter portion supported on the bottom of said first water tank.

* * * * *